United States Patent [19]

Donan, Jr. et al.

[11] Patent Number: 4,557,631

[45] Date of Patent: Dec. 10, 1985

[54] OFF-CENTER ROCK BOLT ANCHOR AND METHOD

[76] Inventors: David C. Donan, Jr., Rte. #1, Manitou, Ky. 42436; David M. Donan, 601 Sharon Garden Ct., Woodbridge, N.J. 07095

[21] Appl. No.: 526,959

[22] Filed: Aug. 29, 1983

[51] Int. Cl.[4] ..... E21D 20/00; E21D 21/00; F16B 13/06

[52] U.S. Cl. ..... 405/259; 411/21; 411/54

[58] Field of Search ..... 405/259–261; 411/21, 39, 45, 47, 49, 53, 55, 57, 60, 71–74, 54; 52/698, 704

[56] References Cited

U.S. PATENT DOCUMENTS

| | | | |
|---|---|---|---|
| 1,767,019 | 6/1930 | Sergeeff | 411/60 |
| 2,988,950 | 6/1961 | Dempsey | 405/259 X |
| 3,938,420 | 2/1976 | Draa | 411/53 |
| 4,147,458 | 4/1979 | Elders | 405/259 |
| 4,195,547 | 4/1980 | Giannuzzi | 411/54 |
| 4,293,244 | 10/1981 | Donan, Jr. | 405/259 |
| 4,295,760 | 10/1981 | Warner | 405/259 |
| 4,380,407 | 4/1983 | Donan, Jr. | 405/259 |
| 4,403,894 | 9/1983 | Clark | 411/47 |
| 4,437,795 | 3/1984 | White | 405/259 |

FOREIGN PATENT DOCUMENTS

| | | | |
|---|---|---|---|
| 156713 | 8/1952 | Australia | 405/259 |
| 2436001 | 7/1975 | Fed. Rep. of Germany | 411/60 |
| 1092415 | 11/1960 | German Democratic Rep. | 405/259 |

*Primary Examiner*—C. J. Husar
*Assistant Examiner*—Nancy J. Stodola
*Attorney, Agent, or Firm*—Cahill, Sutton & Thomas

[57] ABSTRACT

An off-center rock bolt anchor includes a wedge nut having a modified frusto-conical lower end portion having a first surface portion with an enlarged radius of curvature matching that of the mine roof bolt hole. A threaded hole for receiving the shaft of a roof bolt extends longitudinally through the wedge nut parallel to and close to the first surface. A locking cam with outwardly oriented teeth is pivotally connected to an off-center portion of the top surface of the wedge nut. A plurality of expansion wings are positioned around the lower conical portion of the wedge nut and expand outwardly to engage the walls of the bolt hole as the wedge nut is tightened onto the roof bolt. Initial rotation of the bolt causes eccentric rotation of the wedge nut that urges the teeth of the locking cam to engage the side of the bolt hole. Further rotation of the wedge nut causes the pivot connection of the locking cam to act as a pivot point, urging the wedge nut and the teeth of the locking cam against opposite walls of the bolt hole, preventing further rotation of the wedge nut.

7 Claims, 18 Drawing Figures

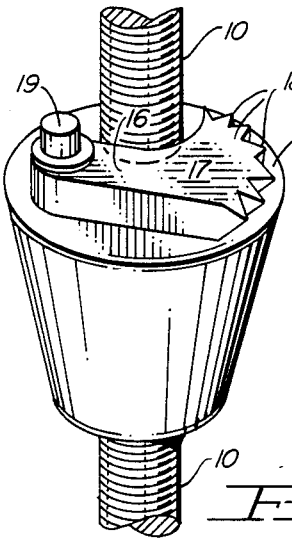
FIG. 4E
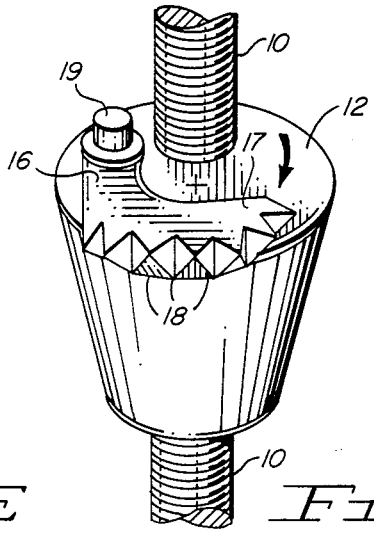
FIG. 4D
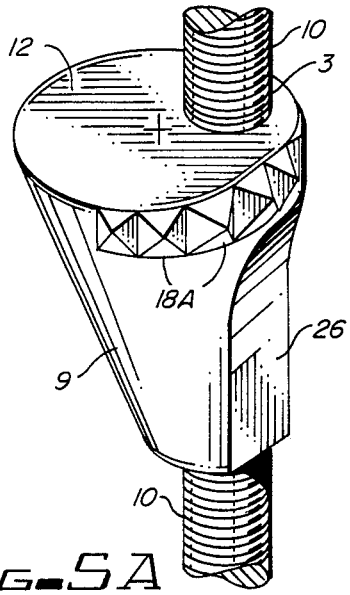
FIG. 5A
FIG. 5B
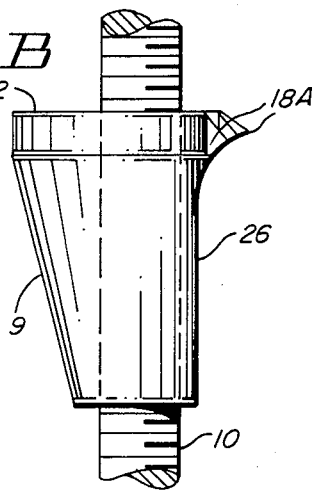
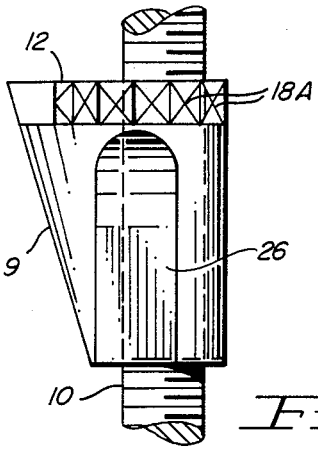
FIG. 5C
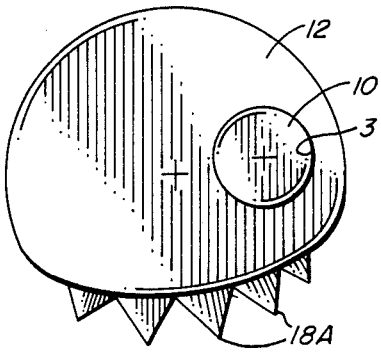
FIG. 5D

OFF-CENTER ROCK BOLT ANCHOR AND METHOD

BACKGROUND OF THE INVENTION

The invention relates to mechanical expansion mine roof bolts, and more particularly to expansion shell assemblies thereof which can be reliably anchored into strata surrounding a bolt hole.

A variety of mine roof bolt assemblies are known in the art. They usually include a bolt of from three to six feet in length, a support plate through which the roof bolt extends and an expansion shell assembly threaded onto a threaded upper end of the roof bolt. A mine roof bolt hole is drilled, usually perpendicular to the surface of the mine roof, and the expansion shell assembly installed on the upper end of a roof bolt is inserted into the roof bolt hole such that the support plate abuts and supports the mine roof. The roof bolt then is tightened, causing the expansion shell assembly to expand, thereby anchoring the entire assembly, including the roof bolt, to the mine roof strata and forcing the support plate upwardly against the mine roof. Exemplary of the prior art are U.S. Pat. Nos. 4,095,431; 4,100,748; 4,292,244; and 4,295,760.

However, when conventional mechanical expansion type mine roof bolts have been inserted into a roof bolt hole, and the nut at the lower end of the roof bolt then is torqued to tighten it, the anchor shell sometimes fails to engage the wall of the bolt hole. In this event, the expansion shell simply rotates with the roof bolt and fails to become anchored therein. Such failures of anchoring are quite frequent, and can be caused by an oversized bolt hole, improper adjustment of the relationship between the wedge nut and the expansion wings of the anchor assembly, or failure of the wedge nut to advance down the threaded shank of the bolt. Furthermore, if the bolt threads or wedge nut threads are rusted, or if there is grit in the threads, or if they are damaged or inadequately lubricated, the anchor shell may fail to engage the roof bolt walls adequately to prevent it from rotating with the bolt. The wedge nut then will not advance into the expansion wings and spread them to cause anchoring.

When the expansion shell assembly initially fails to engage the wall of the bolt hole, the bolt assembly typically is maneuvered around in the hole, and further attempts are made to engage the anchor shell with the wall of the bolt hole, but if this fails, the bolt and anchor shell assembly must be withdrawn. The shell assembly must then be carefully adjusted to hopefully achieve adequate engagement with the bolt hole wall. Sometimes this requires several attempts to achieve proper adjustment, and sometimes, especially if the wedge nut is very tightly engaged with the roof bolt due to rusted or damaged threads, it is necessary to simply withdraw the assembly and replace it with another bolt anchor assembly. These inconveniences are time consuming and costly.

Therefore, it is an object of the invention to provide an improved expansion shell anchor assembly for use with a mine roof bolt to assure adequate engagement of the anchor shell assembly with the roof bolt to cause advancement of the wedge nut during torquing of the roof bolt, thereby anchoring the expansion shell without undue inconvenience.

It is another object of the invention to provide an expansion shell anchor assembly which is inexpensive and yet reliably engages a bolt hole to assure anchoring despite rust or damage of threads of the bolt or wedge nut.

SUMMARY OF THE INVENTION

Briefly described and in accordance with one embodiment thereof, the invention provides a roof bolt or rock bolt anchoring apparatus and method including an expansion shell assembly with a wedge nut having an off-center threaded hole through which the threaded end of the roof bolt or rock bolt extends. In one described embodiment of the invention, the wedge nut has a modified frusto-conical lower portion with a first surface portion thereof having a substantially larger radius of curvature than the radius of curvature of the remaining portion of the frusto-conical section. The larger radius of curvature is roughly the radius of curvature of the roof bolt hole or rock bolt hole into which the expansion shell assembly is to be anchored. A longitudinal axis of the threaded off-center hole in the wedge nut (through which the threaded end of the bolt extends and mates) is parallel to the relatively "flatter" first surface portion of the wedge nut. An off-center pivot pin extends upward from the top surface of the wedge nut. A locking cam is pivotally connected by means of the pivot pin to the top surface of the wedge nut, and has a plurality of outwardly oriented teeth which extend slightly beyond the first surface portion of the wedge nut. A plurality of expansion wings engage the bottom of the wedge nut and are forced by the wedge nut to spread outward as the wedge nut advances or is drawn into the region between the expansion wings as a result of torquing of the roof bolt or rock bolt in order to anchor it into a bolt hole. One of the expansion wings that is positioned along the first surface of the wedge nut has a sloped surface that mates with a relatively more steeply sloped portion of the first surface of the wedge nut to ensure that the expansion wing expands outwardly at the same rate as the other expansion wings as the bolt is torqued and the wedge nut is drawn into the region between the expansion wings.

In operation, the threaded end of the bolt with the expansion shell anchor assembly thereon is inserted into a bolt hole to position the expansion shell anchor therein so that the bolt shaft is positioned off center relative to the center of the bolt hole and is parallel to and adjacent to one surface of the bolt hole. As the bolt is initially rotated, the wedge nut is rotated in an eccentric fashion about the off-centered bolt, causing teeth of the locking cam to engage a portion of the wall of the bolt hole. Then, further rotation of the bolt during the torquing operation causes the main body of the wedge nut to pivot about the pivot pin extending through the locking cam, causing the wedge nut to rotate and thereby move against the side of the bolt hole opposite to the side engaged by the teeth of the locking cam. Further torquing of the bolt forces the teeth of the locking cam deeper into the bolt hole wall until any resistance of the threads of the wedge nut and bolt (due to rust or damage of the wedge nut threads or bolt threads) is exceeded. Further torquing causes the wedge nut to be drawn into the region between the expansion wings, spreading them uniformly outwardly to engage the wall of the bolt hole and thereby reliably anchor it. In another embodiment of the invention, the upper surface of the wedge nut is substantially sloped, so that the action of gravity causes the locking cam to pivot so that the teeth initially engage the wall of the bolt hole. In another embodiment of the invention, no locking cam is provided, and instead teeth are provided at the upper portion of the wedge nut along one portion thereof, so that the initial rotation of the bolt, which is positioned in an off-centered fashion in the bolt hole, causes the teeth to dig into the side of the bolt hole due to eccentric rotation of the wedge nut about the bolt.

BRIEF DESCRIPTION OF THE DRAWINGS

FIGS. 4E and 4F are perspective views useful in explaining the operation of the embodiment of the invention of FIGS. 4A–4D.

FIGS. 5A–5D are perspective, front, side and top section views, respectively, of another alternate off-center wedge nut in accordance with the present invention.

DESCRIPTION OF THE INVENTION

Figure 1:
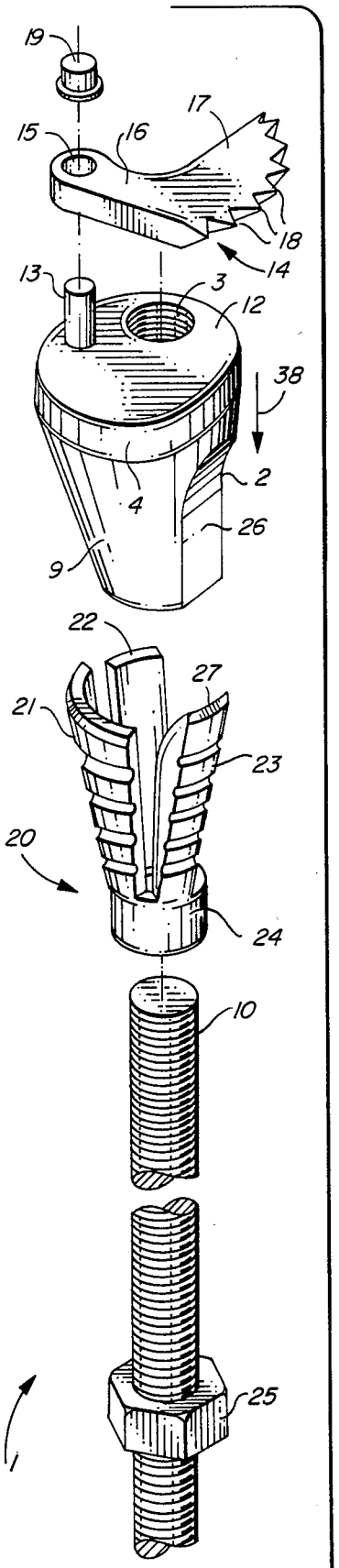
FIG. 1 is a perspective exploded view of the expansion shell assembly of the invention.

Referring now to the drawings, and more particularly to FIGS. 1, 1A, 1B and FIGS. 2A and 2B. Reference numeral 1 designates an exploded perspective view of an expansion anchor shell assembly. Anchor shell assembly 1 includes an off-center wedge nut 2 having a threaded hole 3 therein. The upper portion 4 of wedge nut 2 has a modified cylindrical configuration including a first cylindrical surface 5 (FIG. 1A) having a first radius of curvature and a second cylindrical surface 6 (FIG. 1A) having a larger radius of curvature, so that surface 6 appears as a rather "flattened" surface portion of wedge nut 2. Dotted line 5A in FIG. 1B indicates where the cylindrical surface 5 would extend if the entire outer side surface of the upper portion 4 of off-center wedge nut 2 had a constant radius of curvature.

Figure 1A:
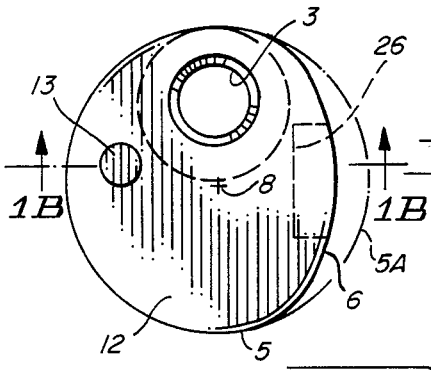
FIG. 1A is a different perspective view of the wedge nut shown in FIG. 1.
Figure 1B:
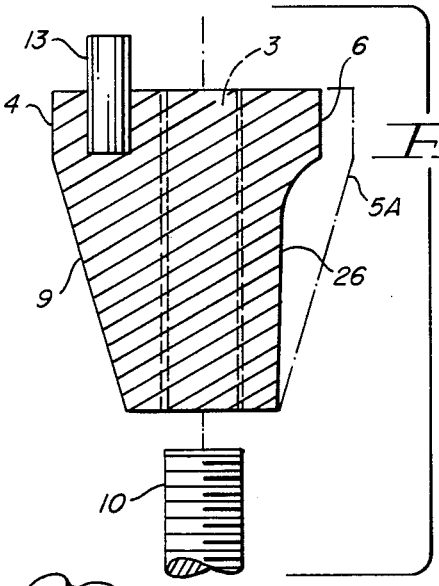
FIG. 1B is a section view along section line 1B—1B of FIG. 1A.

It can be clearly seen in FIG. 1B that threaded bolt hole 3 is "off-center" with respect to the center point 8, which is the center of curvature of the cylindrical surface 5.

The lower portion 9 of wedge nut 2 has a modified frusto-conical configuration, such that in any plane perpendicular to the axis of roof bolt 10 a cross section has the same general appearance as shown in FIG. 1A. That is, the radius of curvature of the surface portion corresponding to and directly beneath cylindrical surface 5 has a substantially smaller radius of curvature than another surface portion corresponding to and located beneath surface 6. (FIG. 1A).

The upper surface 12 of wedge nut 2 is generally flat. An axial pin 13 is rigidly attached to the upper surface 12, and is positioned in an offset relationship to center point 8 (FIG. 1B). A locking cam 14 has a hole 15 therein which receives axial pin 13. Locking cam 14 has an arm portion 16 and a bolt hole engagement end or foot portion 17 with a plurality of sharp teeth 18 extending outwardly from wall engaging foot 17. Hole 15 is disposed in the opposite end of arm 16 from foot 17. The bottom surface of locking cam 14 is smooth, as is the top surface 12 of wedge nut 2, allowing locking cam 15 to pivot freely on pin 13. A retaining cap 19 functions as a cam retainer to retain locking cam 14 on axle pin 13. The curved recess in arm 16 allows locking cam 14 to pivot through a suitable angle despite the presence of bolt 10 extending through bolt hole 3, as is more clearly seen in FIGS. 3A–C.

Expansion anchor shell assembly 1 further includes an expansion wing assembly 20, which typically includes three or four expansion wings such as 21, 22 and 23 connected together at their base by means of a band 24. As is well known in the art, the lower frusto-conical portion 9 of wedge nut 2 is drawn into the region bounded by expansion wings 21, 22, 23 during tightening of roof bolt 10. A base nut 25 maintains expansion wing assembly 20 stationary relative to the longitudinal position of the bolt 10 while wedge nut 2 is drawn or advanced toward expansion wing assembly 20, forcing expansion wings 21, 22, 23 outwardly to engage the walls of the bolt hole and thereby anchor an expansion anchor shell assembly 1 into the bolt hole. Numerous expansion anchor shell assemblies are known in the art, so further details thereof need not be described.

The two expansion wings 21 and 22 have smooth, rounded inner surfaces which slide along the conical portion of the lower frusto-conical section 9 of wedge nut 2 and expand outward by a predetermined amount as the roof bolt or rock bolt 10 is rotated (provided, of course, wedge nut 2 does not rotate with bolt 10). However, the slope of the portion of frusto-conical section 9 of wedge nut 2 corresponding to the flattened arc surface 6 (FIG. 1B) is different than that portion corresponding to the "circular arc" surface portion 5. In order to cause expansion wing 23 to move outward at the same rate as expansion wings 21 and 22, a surface 26, which is best seen in FIG. 1B, and is curved with respect to the longitudinal direction of bolt 10 and is flat in the transverse dimension, is provided on a portion of "flattened arc surface" 6. Correspondingly, the upper inner surface 27 of expansion wing 23 is correspondingly curved, so that despite the generally less steep character of flattened arc surface 26 relative to curved arc surface 5, all of the expansion wings move outwardly at the same rate as the bolt 10 is tightened.

Figure 2A:
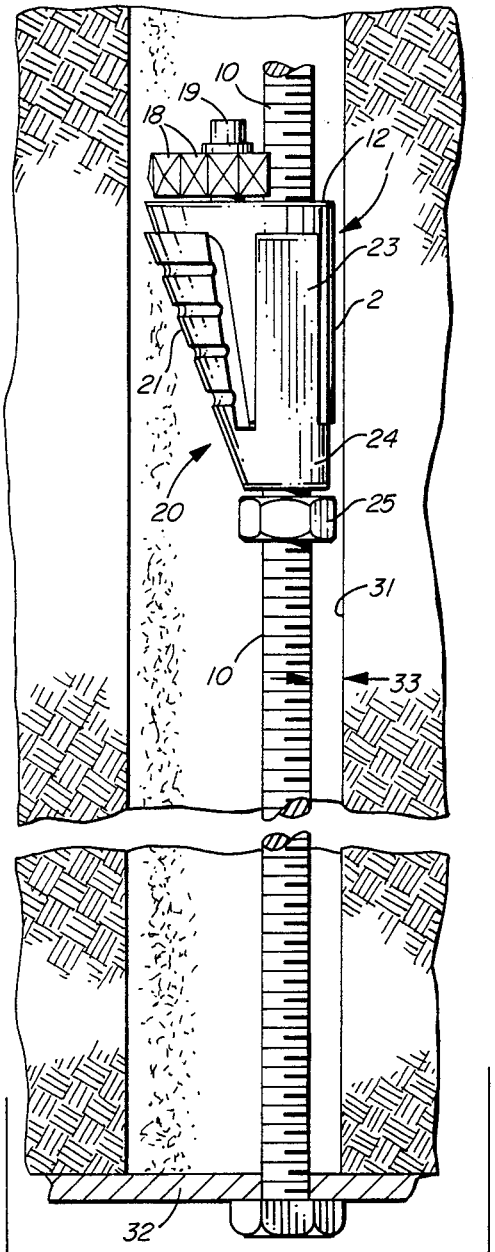
FIG. 2A is a section view showing the initial position of the off-center rock bolt anchor of the present invention in a mine roof bolt hole prior to anchoring.
Figure 2B:
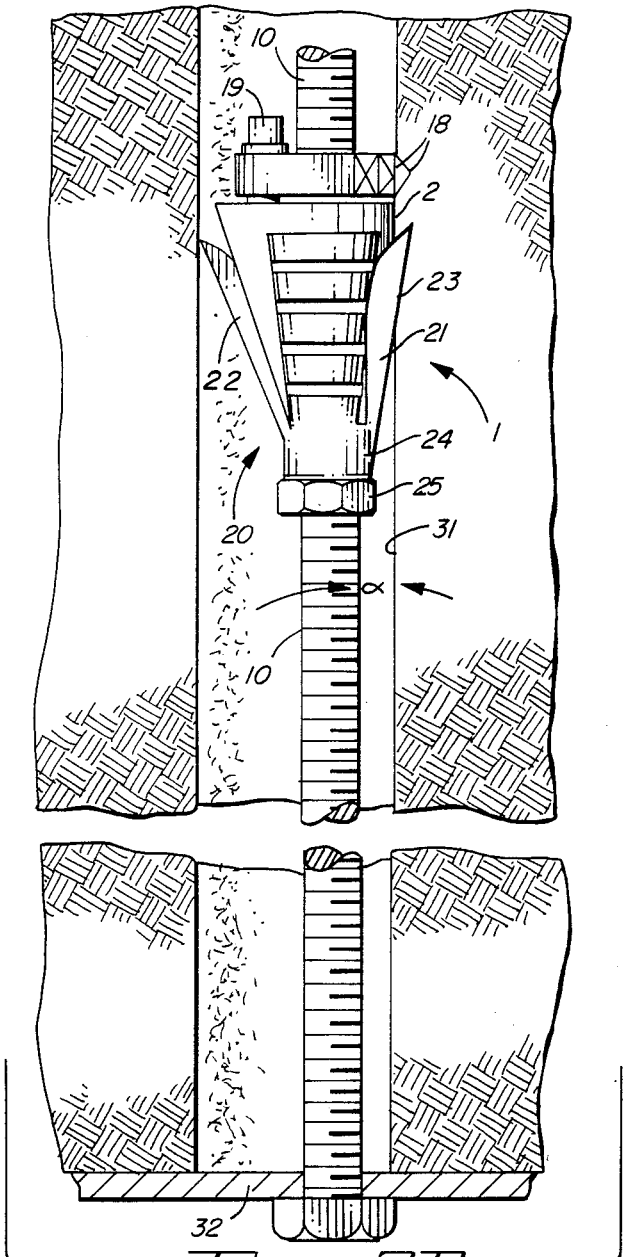
FIG. 2B is a section view diagram similar to that shown in FIG. 1 after rotating the wedge nut to produce anchoring in the roof bolt hole.

The operation of the expansion anchor shell assembly 1 can be best understood by first referring to FIG. 2A, which illustrates how expansion anchor shell assembly 1 is mounted on the threaded end portion of roof bolt 10 and which is positioned in a mine roof bolt hole 31, as shown. Reference numeral 32 represents the base plate having a hole through which the shank of roof bolt 10 extends. Initially, roof bolt 10 is positioned so that its shank is parallel to and very close to one side of roof bolt hole 31, as indicated by the distance 33 in FIG. 2A.

Figure 3A:
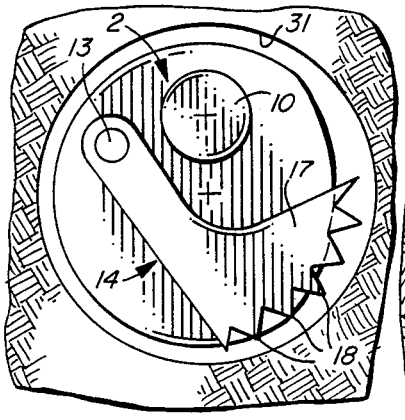
FIGS. 3A–3C are top views of the off-center edge nut useful in explaining the operation of the invention.
Figure 3B:
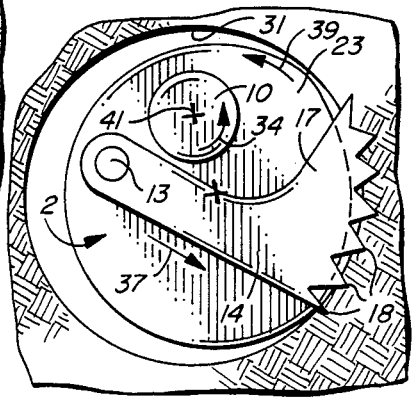
Figure 3C:
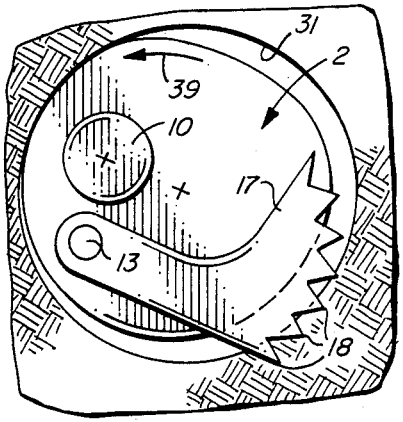

A top view of the expansion anchor shell assembly 1 is shown by FIG. 3A. At this point, it is seen that the teeth 18 of locking cam 14 are not yet in engagement with the wall of bolt hole 31, nor is any portion of the wedge nut 2. If roof bolt 10 then is rotated in the direction of arrow 34 (FIG. 3B) this causes wedge nut 2 to rotate in the direction of arrow 39 about the longitudinal axis 41 of bolt 10. Since pin 13 is offset relative to the longitudinal axis 41 of roof bolt 10, wedge nut 2 acts as a crank, moving locking cam 14 to the right in the direction of arrow 37, as shown in 3B. The teeth 18 on foot 17 therefore engage and begin to dig into the right side of bolt hole 31, as shown in FIG. 3B. When the right hand side of bolt hole 31 provides enough resistance to prevent further movement to the right of locking cam 14, continued rotation of roof bolt 10 in the counterclockwise direction indicated by arrow 34 in FIG. 3B either overcomes any resistance due to friction between the threads of roof bolt 10 and bolt receiving hole 3 (FIG. 1) of wedge nut 2 and begins advancing wedge nut 2 downward in the direction of arrow 38 (FIG. 1) into expansion wing assembly 1, or else causes wedge nut 2 to begin rotating counterclockwise in the direction of arrow 39 (FIG. 3B). In the latter case, rotation of wedge nut 2 in the direction of the arrow 39 (FIGS. 3B and 3C is about pin 13. Due to the forces on pin 13 and on the cylindrical circular arc surface 5 (FIG. 1A) along the surface of bolt hole 31, wedge nut 2 moves to the position shown in FIG. 3C, if the frictional engagement between the threads of roof bolt 10 and bolt receiving hole 3 does not yield.

Once the configuration shown in FIG. 3C is attained, further torque applied in the counterclockwise direction to roof bolt 10 forces teeth 18 further into the bolt hole wall until the frictional resistance is overcome, so that further tightening of the roof bolt 10 draws the lower frusto-conical portion 9 of wedge nut 2 between the expansion wings 21, 22 and 23, finally securely anchoring the expansion anchor shell assembly 1 into bolt hole 31.

It can be seen that the previously described problem of rotation of the entire anchor shell assembly within the bolt hole is avoided by the above-described embodiment of the invention, which assures that this will not happen.

Figure 4B:
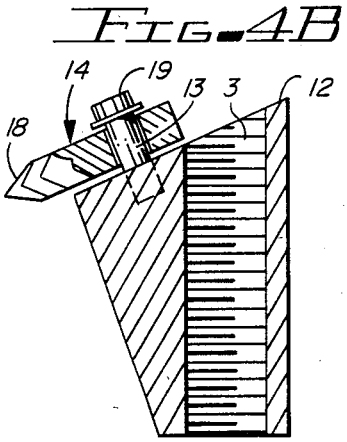
FIGS. 4A–4D are perspective, section, side, and top views, respectively, of an alternate off-center wedge nut with a sloping upper surface.
Figure 4A:
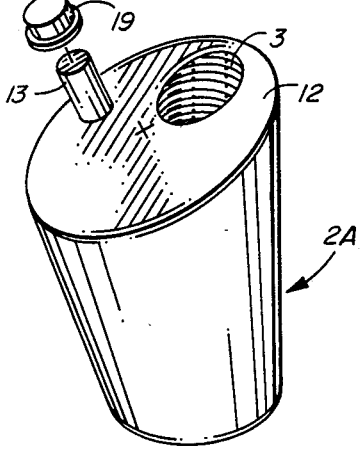
Figure 4D:
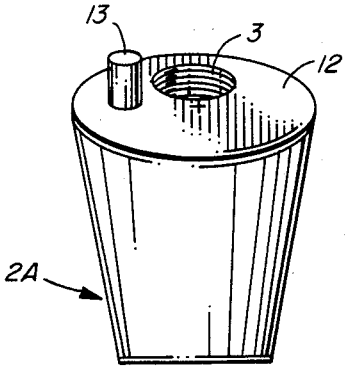
Figure 4C:
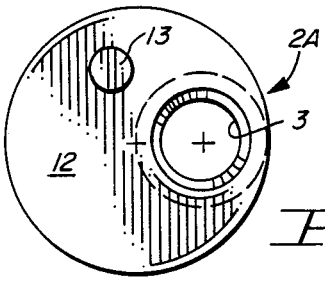

Referring now to FIGS. 4A–4F, an alternate embodiment of the invention which is quite similar to that shown in FIG. 1 is shown, except that the upper surface 12 is substantially sloped relative to the longitudinal axis of threaded bolt hole 3. The frusto-conical lower section of the wedge nut 2A shown in FIGS. 4A–4B does not have the flattened arc portion, as does the wedge nut 2 shown in FIGS. 1, 1A and 1B. Instead, the substantial slope (which can be approximately 30° or more) of surface 12 relative to the vertical position of bolt receiving hole 3 is "steep" enough that when the locking cam 14 shown in FIG. 1 is placed on pin 13 in FIGS. 4A–4C, the force of gravity will cause the foot end 17 of locking cam 14 to swing downward so that the foot portion continually rests against the wall of the bolt hole. Thus, when the roof bolt 10 is initially rotated counterclockwise (as viewed from the top, as shown in FIG. 4C), at least some of the teeth 18 of locking cam 14 will already be in contact with the surface of the bolt hole and will immediately produce a counterforce that causes wedge nut 2A to "dig" into the wall of the bolt hole, as generally shown in FIG. 3C, if the friction of the threads in hole 3 and the threaded end 3 of roof bolt 10 is not first overcome.

Referring now to FIGS. 5A–5D, another much lower cost, less complex, off-center wedge nut is shown, wherein the teeth 18A are formed in the upper peripheral portion of the "flattened arc portion" of the wedge nut. Although this device might be quite useful in relatively soft strata into which a bolt hole is formed, it does not have the advantages of the opposed forces generated by locking cam 14 and wedge nut 2 described in the previous embodiments of the invention. Nevertheless, the arrangement of FIGS. 5A–5D may provide improved anchoring of expansion anchor shell assemblies in certain kinds of soft strata.

While the invention has been described with reference to a particular embodiment thereof, those skilled in the art will be able to make various modifications to the disclosed embodiment of the invention without departing from the true spirit and scope thereof. It is intended that apparatus and method which are the substantial equivalents of those disclosed herein, in that they perform substantially the same function in substantially the same way to obtain substantially the same result, are encompassed within the invention. For example, even though the embodiment of the invention disclosed in FIG. 1 has the "flattened arc surface" 6 which provides a maneuver space beyond which the teeth 18 of locking cam 14 initially extend, the desirable action of locking cam 14 can nevertheless be obtained even though the upper periphery of wedge nut 2 is substantially circular, as long as the radius of curvature is small enough that the teeth 18 of locking cam 20 initially extend somewhat beyond the periphery of the wedge nut, provided that the bolt receiving hole 3 and pin 13 are offset in the same or equivalent fashion to that previously described.

We claim:

1. An expansion shell assembly for use with a roof or rock bolt, said expansion shell assembly comprising in combination:

(a) wedge nut means for receiving a threaded end of the bolt, said wedge nut means having an off-center threaded hole therein for receiving said threaded end, a major portion of said wedge nut means being disposed on one side of said off-center threaded hole;

(b) expansion wing means, slidably disposed about said wedge nut means, for expanding to engage a bolt hole wall in response to rotation of the bolt relative to said wedge nut means;

(c) a flat upper surface on said wedge nut means;

(d) anchoring means, pivotally connected to a pivot point on said flat upper surface, and extending outwardly from said major portion of said wedge nut means, for anchoring said expansion wing means to a first portion of a bolt hole wall by pivoting in the plane of said flat upper surface and moving toward the first portion of the bolt hole wall in response to initial eccentric rotation of said wedge nut means about said bolt; and (e) pivot means for pivoting said wedge nut means about said anchoring means to force a portion of said wedge nut means that is spaced from said pivot point against a second portion of the bolt hole wall opposite to said first portion thereof in response to further rotation of said bolt and wedge nut means, to prevent further rotation of said expansion shell assembly as said bolt continues to rotate.

2. The expansion shell assembly of claim 1 wherein said anchoring means includes a plurality of sharp teeth at an outer portion of said anchoring means for engaging said first portion of said bolt hole.

3. The expansion shell assembly of claim 2 wherein said pivot means includes a pivot pin attached to said pivot point of said flat upper surface, and also includes means for retaining said anchoring means on said pivot pin.

4. The expansion shell assembly of claim 3 wherein said flat upper surface is sufficiently sloped to cause the force of gravity acting on said anchoring means to cause said anchoring means to swing downward along the sloped flat upper surface and into initial contact with said first portion of said bolt hole.

5. The expansion shell assembly of claim 3 wherein said wedge nut means includes an upper section, said upper section including a first peripheral portion having a radius of curvature approximately equal to the radius of said bolt hole, said upper section also including a second peripheral portion having a radius of curvature that is substantially less than the radius of said bolt hole, wherein said off-center threaded hole is disposed adjacent to said first peripheral portion of said upper section, the larger radius of curvature of the first peripheral portion ensuring that the teeth of said anchoring means extend beyond the wedge nut means and can engage said first portion of the bolt hole wall in response to said initial eccentric rotation of said wedge nut means.

6. The expansion shell assembly of claim 5 wherein said expansion wing means includes a plurality of wing elements, including a first wing element located adjacent to said first peripheral portion, said wedge nut means having a variable sloped camming surface adjacent to said first peripheral portion and a constant sloped camming surface adjacent to said second portion, said variably slope camming surface effectuating sliding engagement with said first wing element to force said first wing element to move outward beyond said wedge nut means as far as others of said wing elements in response to said rotation of said bolt relative to said wedge nut means, said others of said wing element effectuating sliding engagement with said constant sloped camming surface, and said constant sloped camming surface effectuating a constant rate of outward movement of said other wing elements with respect to the rotation of the bolt, said variably sloped camming surface effectuating an initially more gradual rate of outward movement of said first wing element than said other wing elements and a later effectuating a more rapid rate of outward movement of said first wing element than said other wing elements, with respect to the rotation rate of the bolt.

7. The expansion shell assembly of claim 2 including a threaded base nut for engaging said plurality of expansion wing means and resisting lateral movement thereof along said bolt during tightening of said bolt.

* * * * *